US008569641B2

(12) United States Patent
Ford

(10) Patent No.: US 8,569,641 B2
(45) Date of Patent: Oct. 29, 2013

(54) ENVIRONMENTALLY PROTECTED SWITCH FOR WATER ACTIVATED DEVICES

(75) Inventor: Timothy D. F. Ford, Beaconsfield (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 287 days.

(21) Appl. No.: 13/003,158

(22) PCT Filed: Jul. 9, 2009

(86) PCT No.: PCT/CA2009/000964
§ 371 (c)(1),
(2), (4) Date: Jan. 7, 2011

(87) PCT Pub. No.: WO2010/003246
PCT Pub. Date: Jan. 14, 2010

(65) Prior Publication Data

US 2011/0155546 A1 Jun. 30, 2011

Related U.S. Application Data

(60) Provisional application No. 61/079,211, filed on Jul. 9, 2008.

(51) Int. Cl.
*H01H 9/04* (2006.01)

(52) U.S. Cl.
USPC ..... 200/302.1

(58) Field of Classification Search
USPC ..... 200/302.1, 61.04, 61.05, 61.2, 61.47, 200/61.6, 182, 184, 190, 221, 222, 230, 200/61.06, 81.9 R, 84 A, 310
See application file for complete search history.

(56) References Cited

U.S. PATENT DOCUMENTS

| | | | | |
|---|---|---|---|---|
| 3,868,160 | A * | 2/1975 | Kersman | 439/39 |
| 4,060,967 | A | 12/1977 | Lorenz | |
| 4,066,870 | A * | 1/1978 | Colten | 219/528 |
| 4,714,914 | A * | 12/1987 | Boe | 340/573.1 |
| 5,034,847 | A | 7/1991 | Brain | |
| 5,311,100 | A | 5/1994 | Brain | |
| 5,410,298 | A * | 4/1995 | Wiseman | 340/610 |
| 5,710,989 | A * | 1/1998 | Flood | 455/100 |
| 5,886,635 | A | 3/1999 | Landa et al. | |
| 5,921,656 | A | 7/1999 | Flood et al. | |
| 7,023,338 | B1 * | 4/2006 | Foth | 340/539.13 |
| 7,056,179 | B2 | 6/2006 | Courtney | |

FOREIGN PATENT DOCUMENTS

| | | |
|---|---|---|
| CA | 2580944 A1 | 9/2007 |
| WO | 2004041363 A2 | 5/2004 |

* cited by examiner

*Primary Examiner* — Edwin A. Leon
*Assistant Examiner* — Anthony R. Jimenez
(74) *Attorney, Agent, or Firm* — Goudreau Gage Dubuc; Hugh Mansfield

(57) ABSTRACT

An environmentally protected switch for activating a signalling device, such as a light source, powered by a battery and adapted for use with a conductive fluid. The switch comprises an open ended housing and a sensing element received within the housing along a longitudinal axis thereof, a tip of the sensing element being substantially flush with the open end. The sensing element is coupled to the signalling device for providing an electrical path connecting the battery and the signalling device. Upon submersion of the switch into the fluid and agitation of the switch, a surface tension at an interface between the fluid and the open end is broken and fluid penetrates the housing up to a predetermined depth to enable an electrical current to flow within the sensing element for closing the electrical path and activating the signalling device.

19 Claims, 4 Drawing Sheets

ENVIRONMENTALLY PROTECTED SWITCH FOR WATER ACTIVATED DEVICES

CROSS-REFERENCE TO RELATED APPLICATIONS

This application is a National Entry Application of PCT application no PCT/CA2009/000964 filed on Jul. 9, 2009 and published in English under PCT Article 21(2), which itself claims benefit of U.S. provisional application Ser. No. 61/079,211, filed on Jul. 9, 2008. All documents above are incorporated herein in their entirety by reference.

FIELD OF THE INVENTION

The present invention relates to an environmentally protected switch for water activated devices, such as safety lights.

BACKGROUND OF THE INVENTION

In order to provide persons in need of rescue with a prompt response in emergency situations, the prior art teaches signaling devices for use with personal flotation devices, such as inflatable life vests and the like. Such signaling devices, which typically comprise a small yet bright light source powered by a battery pack, improve the visibility of a person stranded in water by generating a noticeable flashing signal or strobe. A submersible switch may be included to activate the light source when placed in a conductive fluid, such as water. Still, a major drawback of these prior art devices is that the switch is not environmentally protected and in particular not splash resistant, therefore rendering the light source susceptible to accidental illumination resulting from activation of the switch by inadvertent splashing thereof. This is particularly acute in some applications, for example in fishing operations in heavy seas and the like where the wearer is being repeatedly submerged by waves without being in peril. Additionally, during winter months spray and humidity have a greater affinity for freezing which in many cases can also lead to inadvertent or accidental illumination.

What is therefore needed, and an object of the present invention, is a switch for use with water activated devices, the switch being environmentally (e.g. splash and humidity) resistant in order to prevent accidental triggering (and thus illumination of the signalling device) thereof.

SUMMARY OF THE INVENTION

More specifically, in accordance with the present invention, there is provided an environmentally protected switch for activating a signaling device powered by a battery and adapted for use with a conductive fluid. The switch comprises a housing comprising an open end and a sensing element received within the housing along a longitudinal axis thereof and coupled to the signaling device for providing an electrical path connecting the battery and the signaling device, a tip of the sensing element substantially flush with the open end. Upon submersion of the switch into the fluid and agitation of the switch to break a surface tension at an interface between the fluid and the open end, the fluid penetrates the housing to enable an electrical current to flow within the sensing element for closing the electrical path and activating the signaling device.

In accordance with the present invention, there is also provided a method for activating a signaling device powered by a battery and adapted for use with a conductive fluid, the method comprising providing an environmentally protected switch. The switch comprises a housing comprising an open end and a sensing element received within the housing along a longitudinal axis thereof and coupled to the signaling device for providing an electrical path connecting the battery and the signaling device, a tip of the sensing element substantially flush with the open end. The method further comprises submersing the switch into the fluid and agitating the switch to break a surface tension at an interface between the fluid and the open end, thereby enabling the fluid to penetrate the housing and an electrical current to flow within the sensing element for closing the electrical path and activating the signaling device.

Other objects, advantages and features of the present invention will become more apparent upon reading of the following non-restrictive description of specific embodiments thereof, given by way of example only with reference to the accompanying drawings.

DETAILED DESCRIPTION OF THE ILLUSTRATIVE EMBODIMENTS

Figure 1:
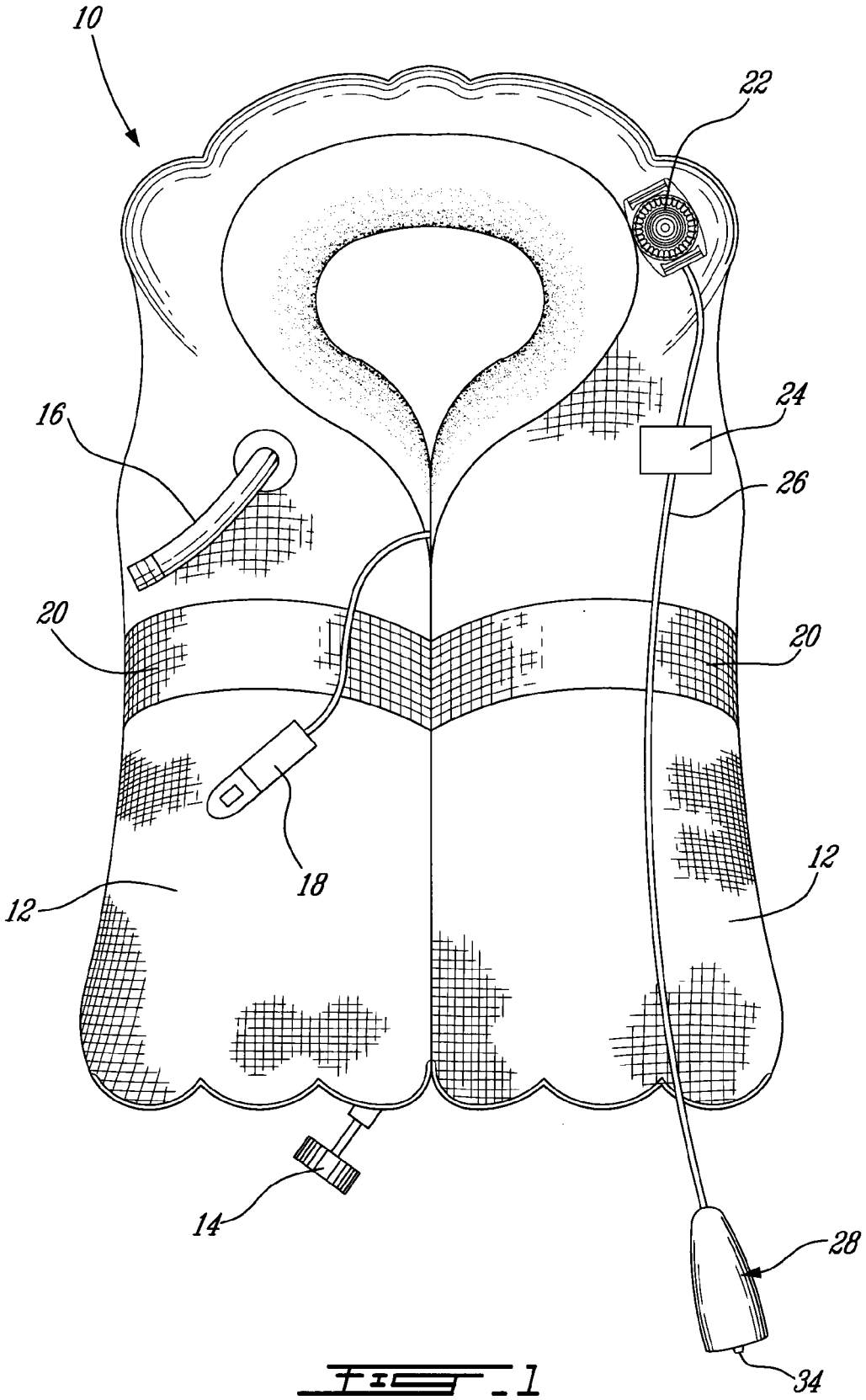
FIG. 1 is a front view of a life vest in accordance with an illustrative embodiment of the present invention.

Referring now to FIG. 1, and in accordance with an illustrative embodiment of the present invention, a life vest, generally referred to using the reference numeral 10, will now be described. The life vest 10 is comprised of one or more chambers as in 12, which are filled with a buoyant material (not shown). In the case of an inflatable vest, the buoyant material is a gas, such as $CO_2$ or air, which is introduced into the chamber(s) from a cylinder or the like (not shown), typically activated by means of a rip cord 14. Additionally, a back up oral inflation tube 16 is provided in order to maintain buoyancy or inflate the vest 10 when the cylinder is empty or inoperable. In order to improve the wearer's chances of being discovered, the outer visible part of the life vest 10 is typically manufactured from a bright material in yellow or day-glow orange. Additionally, the life vest 10 is equipped with a whistle 18 for generating an audible signal, reflective strips as in 20 and a signaling device such as a light source 22.

Figure 2:
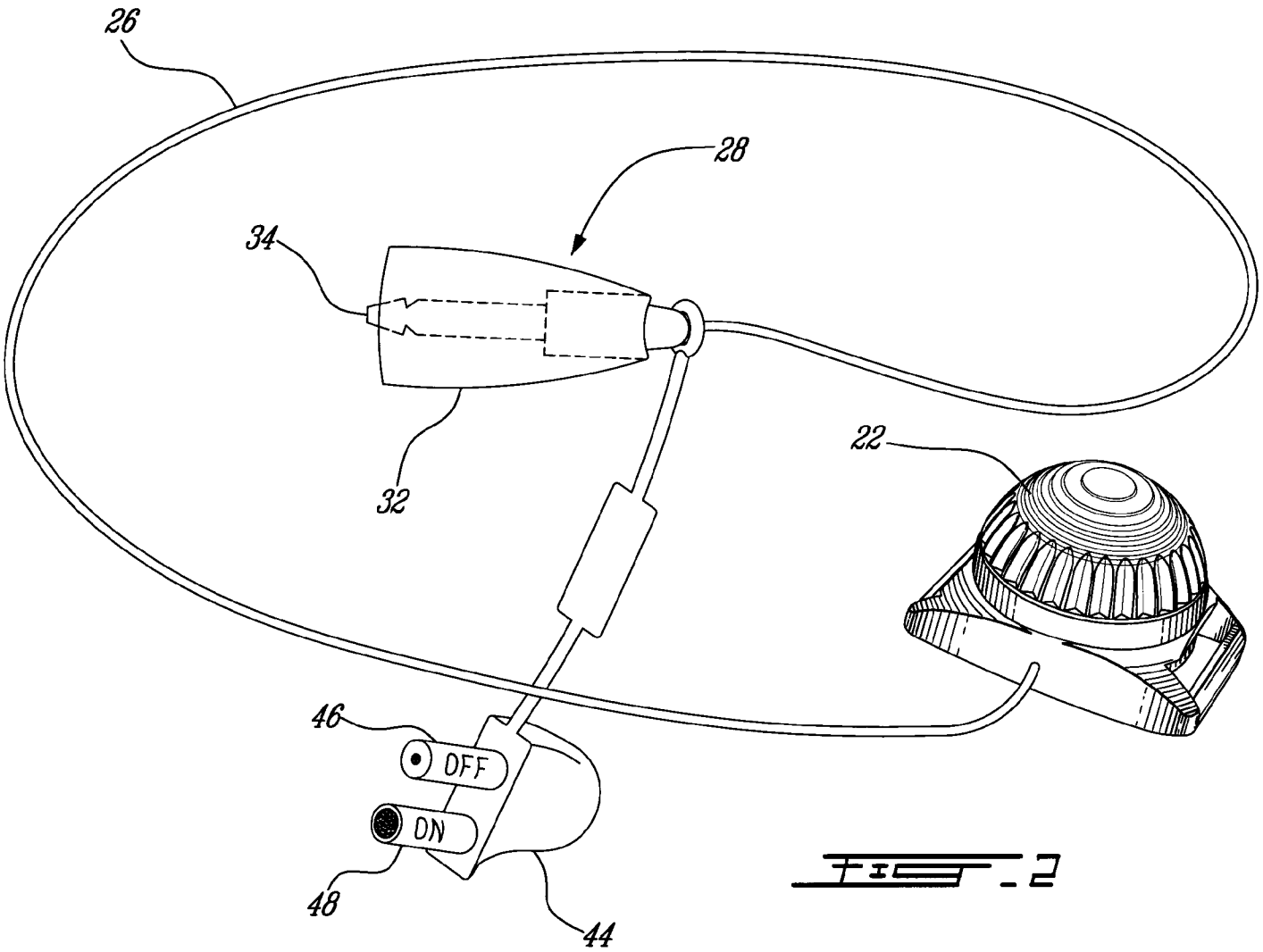
FIG. 2 is a raised front view of a light source and an environmentally protected switch in accordance with an illustrative embodiment of the present invention.
Figure 3:
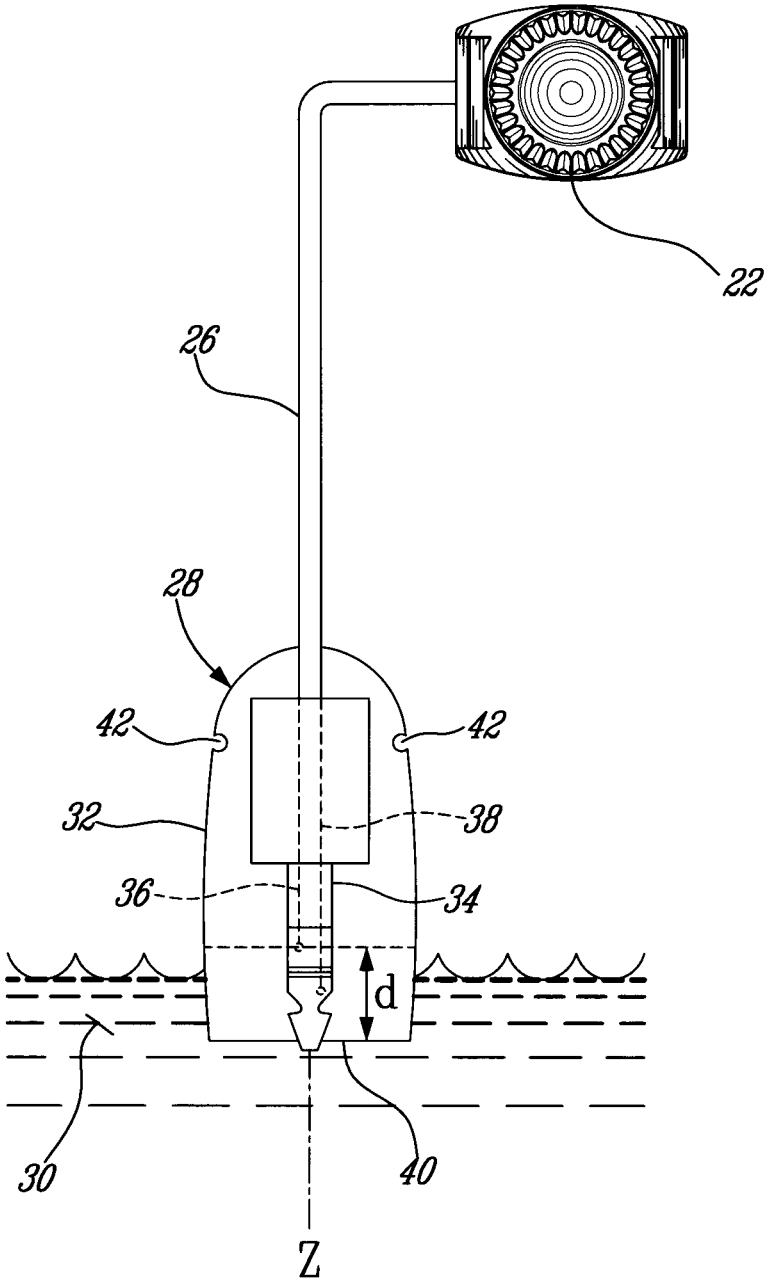
FIG. 3 is a schematic diagram of an environmentally protected switch for activating a light source in accordance with an illustrative embodiment of the present invention.

Referring now to FIG. 2 and FIG. 3 in addition to FIG. 1, the light source 22 is interconnected via an insulated electrical cable 26 with a water proof battery pack 24, which provides power to drive the light source 22. The light source 22 illustratively comprises at least one high power Light Emitting Diode (LED) (not shown) suitable as both a flashing (e.g. according to a predetermined sequence, such as the well-known Morse code representation of SOS) and a steady state light source. Additionally, such high power LEDs are available in a variety of colours as well as infrared, and as a result it is foreseeable that a combination of different colours be included in order to provide a variety of illumination schemes. The light source 22 is illustratively water activated by an environmentally protected switch 28, which is coupled to the light source 22 via the cable 26. The switch 28 is illustratively positioned near the base of the life vest 10 to ensure proper immersion of the switch 28 as a wearer of the life vest 10 is submerged in a conductive fluid 30, such as water. The switch 28 illustratively includes a waterproof housing or shroud 32 covering a pin or probe member 34 (e.g. of the standard RCA connector type) comprising a pair of insulated conductors 36 and 38 for providing an electrical path between the battery 24 and the light source 22 for illumination thereof.

Still referring to FIG. 2 and FIG. 3, it is desirable for an open end 40 of the shroud 32 to be substantially flush with a tip (not shown) of the probe member 34. In this manner, the probe member 34 is protected from penetrating and thus puncturing the life vest (reference 10 in FIG. 1) or other flotation device (not shown) the light source 22 and switch 28 are illustratively mounted to, thus preventing damage to the device. In addition, the open end 40 of the shroud 32 being substantially flush with the tip of the probe member 34 enables the switch 28 to be made wave and splash resistant along a direction transversal to a longitudinal axis Z of the switch 28 as water drops or vapour (e.g. resulting from waves or splashing of the fluid 30 on the switch 28) are prevented from penetrating the shroud 32 and bridging the current between the conductors 36, 38, thus avoiding accidental triggering of the switch 28. Indeed, upon submersion of the switch 28 into the conductive fluid 30, due to the air pressure within the shroud 32 and to the surface tension of the fluid 30, without imparting a mechanical action on the switch 28, the fluid level remains substantially flush with the open end 40 of the shroud 32 and typically little or no fluid 30 penetrates the shroud 32, thus keeping the switch 28 deactivated.

Still referring to FIG. 2 and FIG. 3, the switch 28 is illustratively activated by mechanical action (e.g. agitation thereof by a stranded user, heavy wave action, or the like), which breaks the surface tension of the fluid 30 thus enabling some of the fluid 30 surrounding the switch 28 to penetrate into the shroud 32. Once the fluid has penetrated within the shroud 32 up to a depth d where the fluid reaches the end of conductor 36, current flows between the ends of the conductors 36, 38, thus actuating the switch 28 to illuminate the light source 22. A threshold is therefore created wherein a slight amount of moisture, i.e. below the depth d, will not activate the switch 28 to illuminate the light source 22. Still, although the end of conductor 36 has been shown for illustrative purposes as being positioned at a greater distance (i.e. the depth d) from the tip of the probe member 34 than the end of conductor 38, it will be apparent to a person of skill in the art that both ends of the conductors 36, 38 may be positioned at the same distance from the tip of the probe member 34 without departing from the scope of the present invention. However, it is desirable for the ends of the conductors 36, 38 to be separated by a distance, which enables the flow of an amount of current sufficient to illuminate the light source 22.

Still referring to FIG. 2 and FIG. 3, the shroud 32 advantageously protects the switch 28 from a variety of environmental conditions. Indeed, by preventing moisture to some degree from contacting the ends of the conductors 36, 38, the shroud 32 also prevents or at least reduces the possibility that the light source 22 is accidentally illuminated for example when cold ambient conditions would lead to spray or moisture freezing across the conductors 36, 38, thereby resulting in the formation of ice crystals and the like around the probe member 34 and creating a conductive circuit that would accidentally activate the switch 28.

Still referring to FIG. 2 and FIG. 3, in order to ease the intake of the fluid 30 into the shroud 32 while maintaining many of the environmentally (e.g. splash) resistant characteristics, a plurality of apertures as in 42 may be provided on the shroud 32 at an end thereof opposite the open end 40 to allow a flow of air within the shroud 32. It is desirable for the apertures as in 42 to be large enough to ease fluid intake within the shroud 32 yet small enough to prevent excessive fluid penetration, thus ensuring that the switch 28 remains relatively splash resistant when submersed.

Referring back to FIG. 2, the switch 28 may also be provided with a plug 44 comprising a first sleeve 46 and a second sleeve 48, each sleeve 46, 48 adapted to be mated with the probe member 34 for manually activating or deactivating the switch 28. In particular, the sleeve 48 is illustratively made of a conductive (e.g. copper) material that enables the switch 28 to be brought to an "ON" state by creating an electrical contact between the probe member 34 and the sleeve 48 (and thus between the switch 28 and the conductive fluid 30 the switch 28 is immersed in) when the sleeve 48 is placed over the probe member 34. Similarly, the sleeve 46 is illustratively made of a dielectric material that brings the switch 28 to an "OFF" state by preventing any electrical contact between the probe member 34 and the sleeve 46 (and thus between the switch 28 and the conductive fluid 30). In this manner, the switch 28 can for example be deactivated (e.g. when the life vest 10 is not in use) to prevent accidental illumination of the light source 22, thus saving power from the battery (reference 24 in FIG. 1).

Still referring to FIG. 2, in order to further prevent accidental illumination of the light source 22 a timer circuit (not shown) can be integrated into the light source 22 such that illumination of the light source 22 is only triggered provided that the switch 28 has been adequately submersed in the conductive fluid 30 for a predetermined amount of time, for example 60 seconds or the like. Additionally, a similar timer circuit can also be included to ensure that the light source 22 stays illuminated for a predetermined amount of time if the switch 28 is removed from conductive fluid 30.

Figure 4:
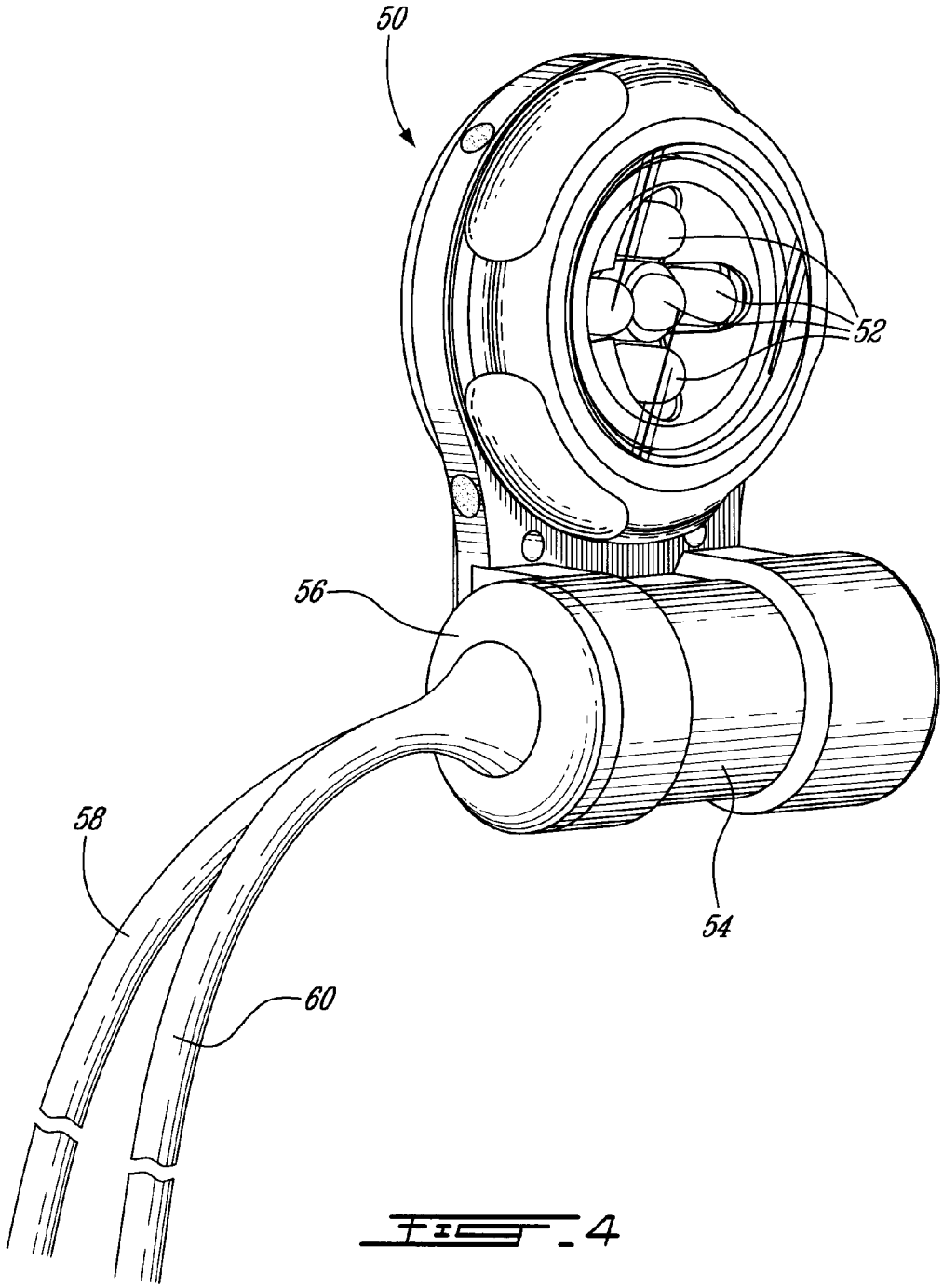
FIG. 4 is a side perspective view of an alternative light source for use with the environmentally protected switch in accordance with an illustrative embodiment of the present invention.

Referring now to FIG. 4, in an alternative illustrative embodiment of the present invention, the light 22 can be replaced by an alternative light source 50 comprising one or more LEDs as in 52 and a battery compartment 54 covered with a suitable adaptor cap 56. The adaptor cap 56 provides the interconnections and electronics necessary to interconnect a control panel or the like (not shown) via an insulated electrical cable 58 with a battery (not shown) within the battery compartment 54 to allow for control of the illumination of the LEDs as in 52. Additionally, the battery pack (reference 24 in FIG. 1), which is combined with the switch 28 and connected with the adaptor cap 56 via a second insulated cable 60, can be used to supplement the battery within the battery compartment 54.

Referring back to FIG. 1, of note is that although the above light source 22 and switch 28 are shown in conjunction with a life vest 10, the light source 22 and switch 28 could also be used in conjunction with other flotation devices, such as inflatable rafts and the like, without departing from the scope of the present invention. In addition, the switch 28 may be used in a variety of applications with signalling devices other than (or in addition to) the light source 22. For example, the switch 28 may be used in alarm systems for the purpose of locating downed personnel in emergency situations. The switch 28 may also be used in conjunction with other water sensing devices (not shown) as an alarm for household applications (e.g. to prevent flooding in basements and garages or to sense high humidity environments in homes), for use on boats, or the like. In such applications, upon activation of the switch by immersion of the switch 28 into a fluid (reference 30 in FIG. 4) for instance, a signal would illustratively be transmitted via an antenna or the like to an alarm device (not shown), such as a horn or siren, adapted to automatically generate an audio alarm.

Still referring to FIG. 1, when used with a light source as in 22 for generating a visual alarm, the switch 28 of the present invention may also suitable for use in low-level lighting applications or for identifying exit ways or the like, in which case the desired lighting is illustratively only provided upon activation of the switch 28 (as discussed herein above). Moreover, in some applications it may be desirable for the switch 28 to be detachable from the light source 22 once the latter has been illuminated by activation of the switch 28 and this could illustratively be done by exerting a pulling force on the cable 26.

Although the present invention has been described hereinabove by way of specific embodiments thereof, it can be modified, without departing from the spirit and nature of the subject invention as defined in the appended claims.

What is claimed is:

1. An environmentally protected switch for activating a signalling device powered by a first battery and adapted for use with a conductive fluid, the switch comprising:

a housing comprising an open end; and an elongate probe member received within said housing along a longitudinal axis thereof, said member comprising a first conductive tip portion and a second conductive portion adjacent said first conductive tip portion along a length of said member, said first conductive tip portion and said second conductive portion coupled to the signalling device for providing an electrical path connecting the first battery and the signalling device, said first conductive tip portion of said probe member substantially flush with said open end;

wherein upon submersion of the switch into the conductive fluid and agitation of the switch to break a surface tension at an interface between the conductive fluid and said open end, the fluid penetrates said housing, the conductive fluid electrically interconnecting said first conductive tip portion and said second conductive portion to enable an electrical current to flow between said first conductive tip portion and a second conductive portion for closing said electrical path and activating the signalling device.

2. The switch of claim 1, wherein the signalling device is a light source adapted to be illuminated upon activation.

3. The switch of claim 1, wherein the signalling device is an alarm device adapted to generate an audio alarm upon activation.

4. The switch of claim 2, wherein said light source comprises at least one high power LED adapted to be illuminated in a selected one of a flashing or a steady state sequence.

5. The switch of claim 2, wherein said light source comprises a battery compartment receiving therein a second battery supplementing the first battery, said battery compartment covered with an adaptor cap interconnecting said second battery with a control panel for controlling an illumination of said light source.

6. The switch of claim 1, wherein said probe member comprises a two conductor phone connector.

7. The switch of claim 1, wherein the fluid may penetrate said housing at least to a predetermined depth and further wherein said end of said second conductive portion is spaced from a tip of said first conductive tip portion by a distance equal to said predetermined depth.

8. The switch of claim 7, wherein penetration of the fluid within said housing to a level below said predetermined depth does not close said electrical path, thereby not activating the signalling device.

9. The switch of claim 1, wherein said housing comprises adjacent an end opposite said open end a plurality of apertures for enabling a flow of air within said housing, thereby easing an intake of the fluid into said housing.

10. The switch of claim 1, further comprising a plug comprising a first sleeve and a second sleeve, each sleeve adapted to be mated with said elongate probe member for selectively manually activating or deactivating the switch.

11. The switch of claim 10, wherein said first sleeve is made of a conductive material creating an electrical contact between said first sleeve and said elongate probe member when said first sleeve is mated with said elongate probe member, thereby enabling said electrical current to flow between said first conductive tip portion and a second conductive portion for closing said electrical path and activating the switch.

12. The switch of claim 10, wherein said second sleeve is made of a dielectric material such that when said second sleeve is mated with said elongate probe member electrical contact between said first conductive tip portion and said second conductive portion is prevented, thereby preventing said electrical current from flowing between said first conductive tip portion and said second conductive portion when fluid penetrates said housing, and thereby deactivating the switch.

13. A method for activating a signalling device powered by a battery and adapted for use with a conductive fluid, the method comprising:

providing an environmentally protected switch, said switch comprising a housing comprising an open end; and an elongate probe member received within said housing along a longitudinal axis thereof, said member comprising a first conductive tip portion and a second conductive portion adjacent said first conductive tip portion along a length of said member, said first conductive tip portion and said second conductive portion coupled to the signalling device for providing an electrical path connecting the battery and the signalling device, a tip of said probe member substantially flush with said open end;

submersing said switch into the fluid; and agitating said switch to break a surface tension at an interface between the conductive fluid and said open end, thereby enabling the conductive fluid to penetrate said housing, the conductive fluid electrically interconnecting said first conductive tip portion and said second conductive portion thereby enabling an electrical current to flow between said first conductive tip portion and said second conductive portion for closing said electrical path and activating the signalling device.

14. The method of claim 13, wherein said elongate probe member comprises a two conductor phone connector.

15. The method of claim 13, wherein the fluid penetrates said housing up to at least a predetermined depth and further wherein said end of said second conductive portion is spaced from said tip of said probe member by a distance equal to said predetermined depth.

16. The method of claim 13, further comprising providing on said housing adjacent an end opposite said open end a plurality of apertures for enabling a flow of air within said housing, thereby easing an intake of the fluid into said housing.

17. The method of claim 13, further comprising providing a plug comprising a first sleeve and a second sleeve, each sleeve adapted to be mated with said elongate sensing member for selectively manually activating or deactivating the switch, wherein said first sleeve is made of a conductive material creating an electrical contact between said first conductive tip portion and a second conductive portion and said second sleeve is made of a dielectric material such that when said second sleeve is mated with said elongate sensing member electrical contact between said first conductive tip portion and said second conductive portion is prevented when fluid penetrates said housing thereby deactivating the switch.

18. The method of claim 17, further comprising mating said first sleeve with said elongate probe member thereby activating the switch.

19. The method of claim 17, further comprising mating said second sleeve with said elongate probe member thereby deactivating the switch.

* * * * *